US008845500B2

(12) United States Patent
Huang

(10) Patent No.: US 8,845,500 B2
(45) Date of Patent: Sep. 30, 2014

(54) RESISTANCE ADJUSTABLE ROTATIONAL EXERCISER

(76) Inventor: Chia-Yu Huang, Taichung (TW)

( * ) Notice: Subject to any disclaimer, the term of this patent is extended or adjusted under 35 U.S.C. 154(b) by 217 days.

(21) Appl. No.: 13/435,921

(22) Filed: Mar. 30, 2012

(65) Prior Publication Data

US 2013/0260969 A1 Oct. 3, 2013

(51) Int. Cl.
*A63B 21/02* (2006.01)

(52) U.S. Cl.
USPC ..... 482/122; 482/126; 482/121

(58) Field of Classification Search
USPC ..... 482/122, 121, 124, 126, 46, 45, 115, 482/44, 47, 49, 50, 48, 114, 118, 106–108, 482/92
See application file for complete search history.

(56) References Cited

U.S. PATENT DOCUMENTS

| | | | | |
|---|---|---|---|---|
| 4,770,409 | A * | 9/1988 | Wallisch | 482/45 |
| 6,406,406 | B1 * | 6/2002 | Onorati | 482/44 |
| 6,776,827 | B2 * | 8/2004 | Hasan | 106/1.11 |
| 7,094,182 | B1 * | 8/2006 | Holten | 482/46 |
| 7,101,086 | B2 * | 9/2006 | Klier | 384/273 |
| 7,238,147 | B2 * | 7/2007 | Mills et al. | 482/106 |
| 7,862,486 | B1 * | 1/2011 | Watson | 482/106 |
| 8,602,951 | B2 * | 12/2013 | Morris | 482/126 |
| 2005/0003931 | A1 * | 1/2005 | Mills et al. | 482/5 |
| 2011/0287909 | A1 * | 11/2011 | Morris | 482/126 |

* cited by examiner

*Primary Examiner* — Loan H Thanh
*Assistant Examiner* — Megan Anderson
(74) *Attorney, Agent, or Firm* — C. G. Mersereau; Nikolai & Mersereau, P.A.

(57) ABSTRACT

A resistance adjustable rotational exerciser includes a body, two rotary members and an adjustment device. The body has two outer rings with a connection plate connected therebetween. The two rotary members are rotatably connected to the outer rings and each have a handle. The adjustment device has front and rear plates respectively connected to the front and rear sides of the connection plate. The front and rear plates have resistance strips. Springs are located between the connection plate and the front and rear plates. A knob is located at the front plate and connected to connection rods connected between the front and rear plates. The user holds the handles to operate the exerciser in different directions to exercise the muscles and joints. By operation of the knob, the distance between the front and rear plates is adjusted to obtain desired resistance.

5 Claims, 10 Drawing Sheets

RESISTANCE ADJUSTABLE ROTATIONAL EXERCISER

BACKGROUND OF THE INVENTION (1) Field of the Invention

The present invention relates to an exerciser for operation by one hand or two hands, and more particularly, to a resistance adjustable rotational exerciser.

(2) Description of the Prior Art

The conventional rotational exerciser is disclosed in FIG. 1 and generally comprises a body 1 and two rotary members 2, wherein the body 1 has two rings 10 and two links 11 are connected between the two rings 10. The two rotary members 2 are rotatably located within the rings 10 and each rotary member 2 has a handle 20 so that the user holds the handles 20 by two hands and rotate or twist the rotary members 2, or the user holds one handle 20 and swings the exerciser to perform Tai-chi actions or boxing actions. By the actions, the muscles of the arms and the joints of the hands are exercised.

However, the two rotary members 2 are rotatable in the rings 10 of the body 1 so that every user can only get the same result when using the exerciser, and this does not meet different requirements from different users. Some users want to exercise with higher resistance and some do not.

The present invention intends to provide a resistance adjustable rotational exerciser to meet the resistance requirements from different users.

SUMMARY OF THE INVENTION

The present invention relates to a resistance adjustable rotational exerciser and comprises a body having two outer rings and a connection plate is connected between the two outer rings. The connection plate has a front side and a rear side which is located opposite to the front side. A through hole is defined centrally through the connection plate and multiple guide rods extend from the front side and the rear side of the connection plate. Two rotary members are respectively and rotatably located within the two outer rings and each rotary member has a handle. An adjustment device has a rear plate, a front plate, multiple resistance strips, multiple springs and a knob, wherein the rear plate is connected to the rear side of the connection plate and two ends of the rear plate extend to the rear side of the two rotary members. The rear plate has a connection rod and multiple rear guiding holes, wherein the connection rod extends through the through hole and has a threaded section. The guide rods on the rear side of the connection plate extend through the rear guiding holes. The front plate is connected to the front side of the connection plate and two ends of the front plate extend to the front side of the two rotary members. The threaded section of the connection rod extends through a hole defined through the front plate and the guide rods on the front side of the connection plate extend through front guiding holes defined through the front plate. The resistance strips are respectively connected to the front and rear plates and in contact with the rotary members to generate resistance. The springs are respectively mounted to the guide rods and bias the front and rear plates away from the rotary members. The knob is connected to the front side of the front plate and has a threaded hole with which the threaded section of the connection rod is connected.

When using the exerciser, the user holds the two handles by two hands and swings or twists the exerciser in different directions, or holds one handle by one hand and swings the exerciser to perform Tai-chi actions or boxing actions. By these actions, the muscles of the arms and the joints of the hands are exercised. By loosening or tightening the knob to adjust the distance between the front and rear plates to adjust the resistance strips to be in contact with the rotary members to generate different resistance so as to have different levels of exercise features.

Two pairs of L-shaped collars are respectively located between the two rotary members and the two outer rings. Each of the rotary members has an inner ring and two covers. The inner ring is co-rotatably located in the outer ring corresponding thereto and the two respective covers are mounted to front and rear sides of the inner ring. The outer periphery of each of the covers reaches to front and rear sides of the outer ring corresponding thereto. The handle is connected to the inner periphery of the inner ring. Each collar is made of durable material with a low friction coefficient and comprises a first annular plate and a second annular plate which is perpendicularly to the first annular plate. The first annular plate is located between the outer ring and the inner ring, the second annular plate is located between the outer ring and the cover. The use of the collars reduces the manufacturing cost and simplifies the structure of the exerciser.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
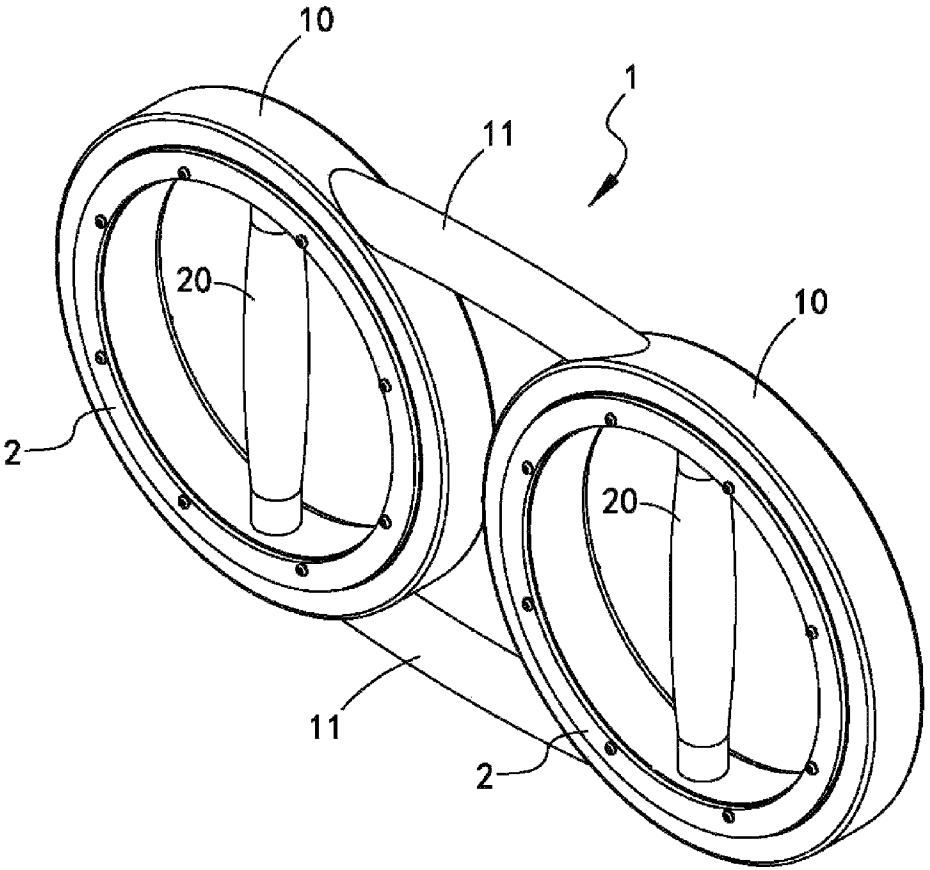
FIG.1 PRIOR ART
FIG. 1 is an exploded view to show the conventional exerciser.
Figure 2:
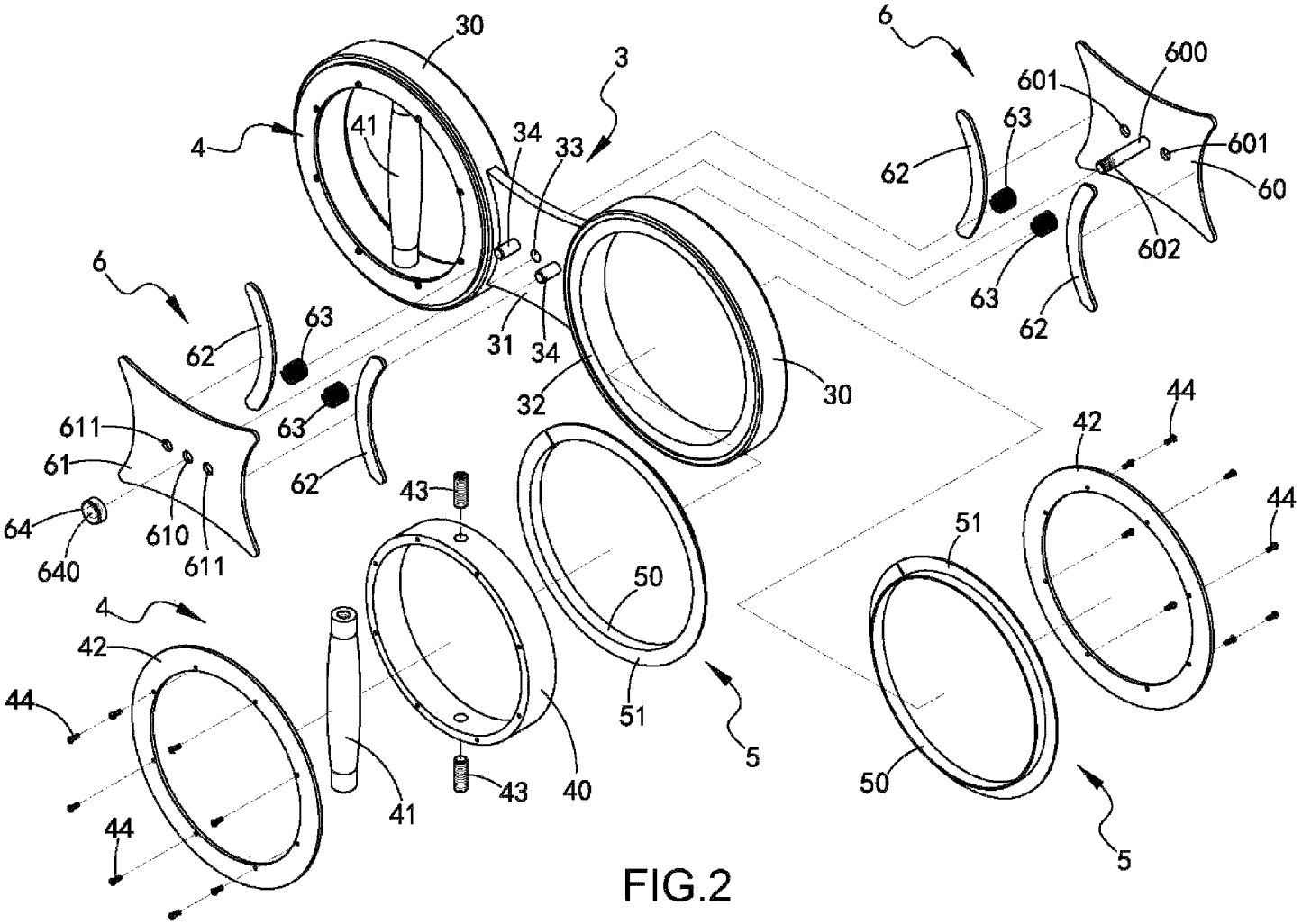
FIG. 2 is an exploded view to show the exerciser of the present invention.
Figure 3:
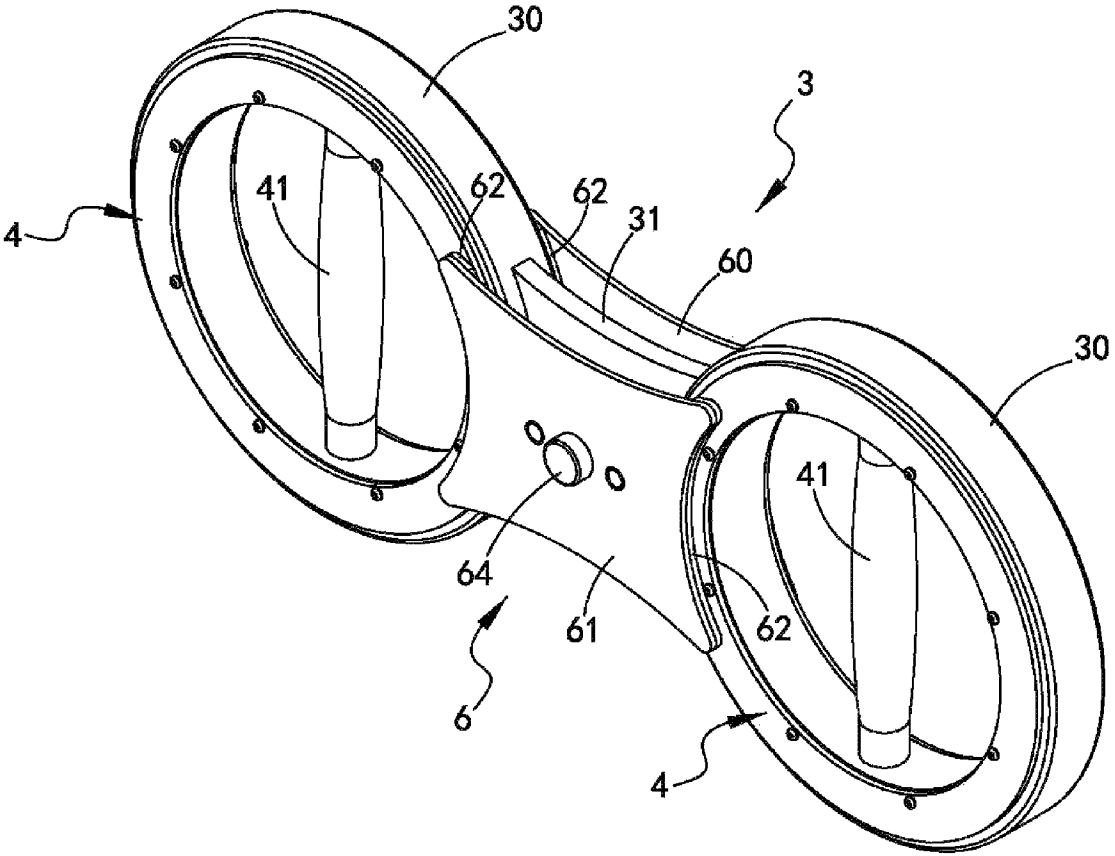
FIG. 3 is a perspective view to show the exerciser of the present invention.
Figure 4:
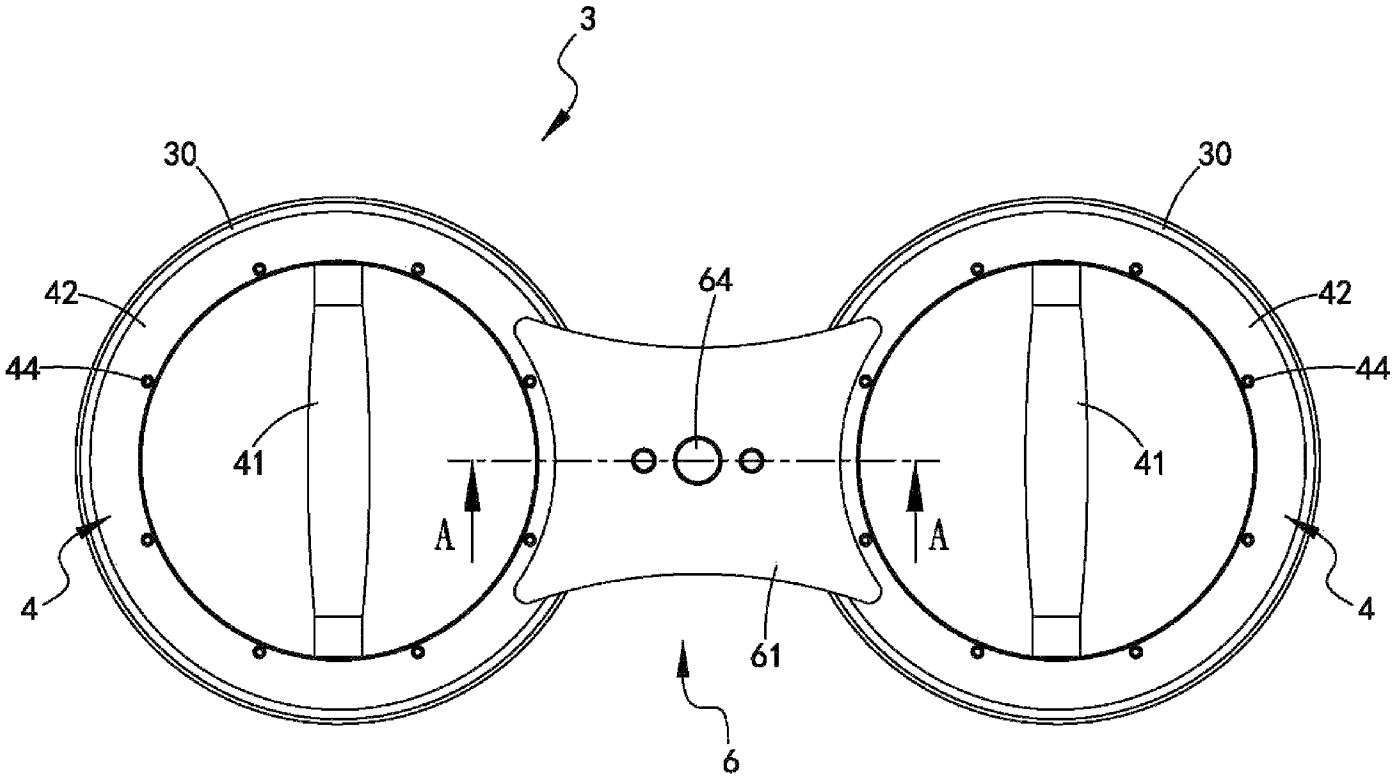
FIG. 4 is a plane view of the exerciser of the present invention.

Referring to FIGS. 2 to 5, the exerciser of the present invention comprises a body 3, two rotary members 4, four collars 5 and an adjustment device 6.

The body 3 has two outer rings 30 located on the same plane and a connection plate 31 is connected between the two outer rings 30. The connection plate 31 has a front side and a rear side which is located opposite to the front side. The outer rings 30 each have two grooves 32 respectively defined in the front side and the rear side thereof. A through hole 33 is defined centrally through the connection plate 31 and multiple guide rods 34 extend from the front side and the rear side of the connection plate 31.

The two rotary members 4 are respectively and rotatably located within the two outer rings 30 and each rotary member 4 has an inner ring 40, a handle 41 and two covers 42. The inner ring 40 is co-rotatably located in the outer ring 30 corresponding thereto and the two respective covers 42 are mounted to front and rear sides of the inner ring 40 by multiple bolts 44. The outer periphery of each of the covers 42 reaches to front and rear sides of the outer ring 30 corresponding thereto. Two ends of the handle 41 are connected to the inner periphery of the inner ring 40 by two threaded members 43.

Two pairs of L-shaped collars 5 are respectively located between the two rotary members 4 and the two outer rings 30. Each collar 5 is made by durable material with a low friction coefficient such as TEFLON (polytetrafluoroethylene or PTFE) and comprises a first annular plate 50 and a second annular plate 51 which is perpendicularly to the first annular plate 50. The first annular plate 50 is located between the outer ring 30 and the inner ring 40, and the second annular plate 51 is engaged with the groove 32 located between the outer ring 30 and the cover 42.

The adjustment device 6 has a rear plate 60, a front plate 61, multiple resistance strips 62, multiple springs 63 and a knob 64. The rear plate 60 is connected to the rear side of the connection plate 31 and two ends of the rear plate 60 extend to the rear side of the two rotary members 4. The rear plate 60 has a connection rod 600 and multiple rear guiding holes 601. The connection rod 600 extends through the through hole 33 and has a threaded section 602. The guide rods 34 on the rear side of the connection plate 31 extend through the rear guiding holes 601. The front plate 61 is connected to the front side of the connection plate 31 and two ends of the front plate 61 extend to the front side of the two rotary members 4 and located on the front side of the two covers 42. The threaded section 602 of the connection rod 600 extends through a hole 610 defined through the front plate 61. The guide rods 34 on the front side of the connection plate 31 extend through front guiding holes 611 defined through the front plate 61. Four resistance strips 62 are respectively connected to the front and rear plates 61, 60 and in contact with the covers 42 on the front and rear sides of the rotary members 4 to generate resistance. The four springs 63 are respectively mounted to the guide rods 34 and bias the front and rear plates 61, 60 away from the rotary members 4. The knob 64 is connected to the front side of the front plate 61 and has a threaded hole 640 with which the threaded section 602 of the connection rod 600 is connected, so that the knob 64 is in contact with the front plate 61.

Figure 5:
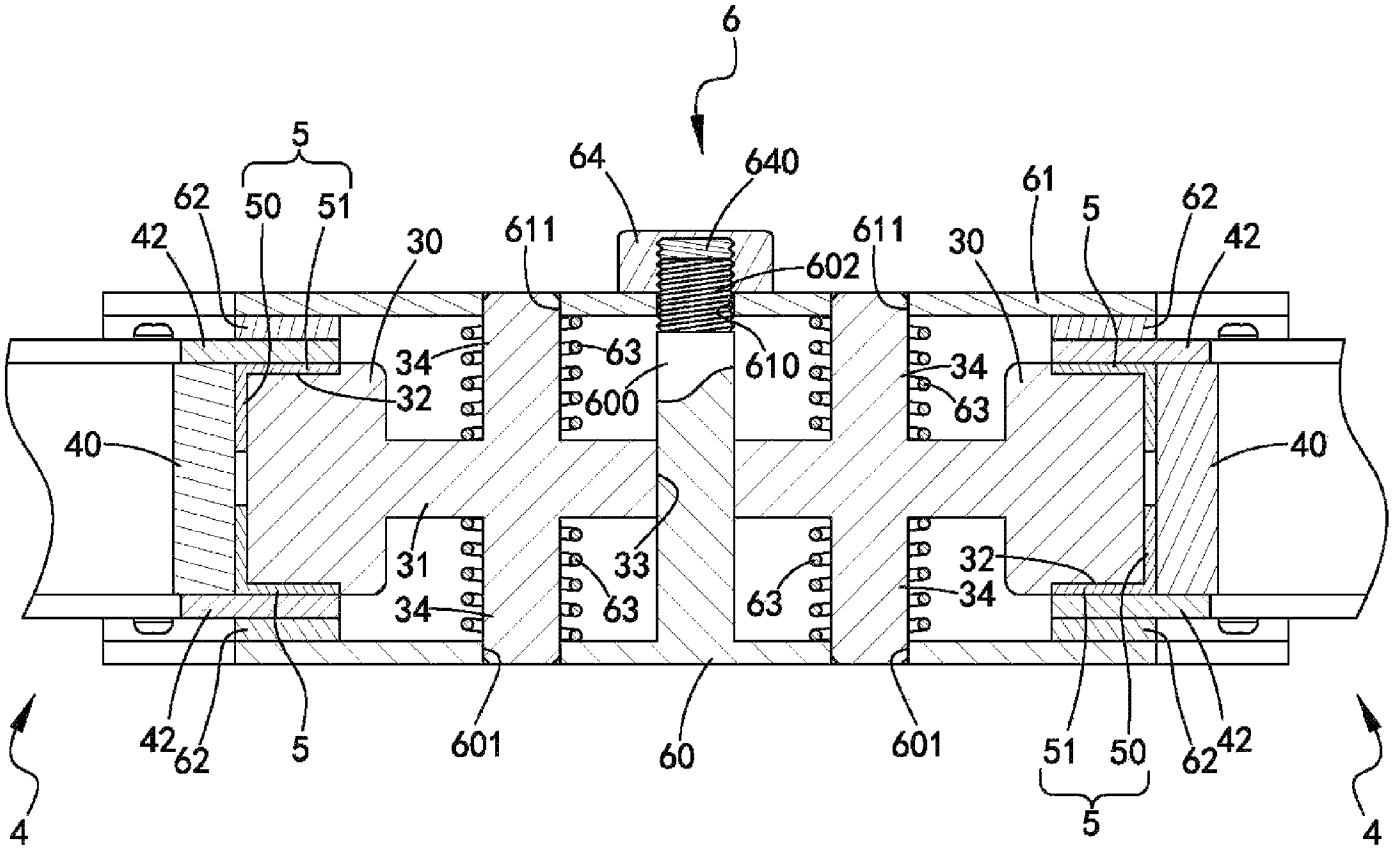
FIG. 5 is an enlarged cross sectional view, taken along line A-A in FIG. 3.

As shown in FIG. 5, the covers 42 restrict the inner rings 40 in the outer rings 30 so that the inner rings 40 can only rotate in the outer rings 30. The collars 5 allow the inner rings 40 to be smoothly rotatable in the outer rings 30. The guide rods 34 are cooperated with the front guiding holes 611 and the rear guiding holes 601 to guide the rear and front plates 60, 61 to be movable linearly relative to the connection plate 31. By tightening the knob 64, the distance between the front and rear plates 60, 61 is set to adjust the force that the resistance strips 62 apply to the covers 42. Therefore, by adjust the force that the resistance strips 62 apply to the covers 42, the resistance is adjusted when the rotary members 4 are rotated.

Figure 6:
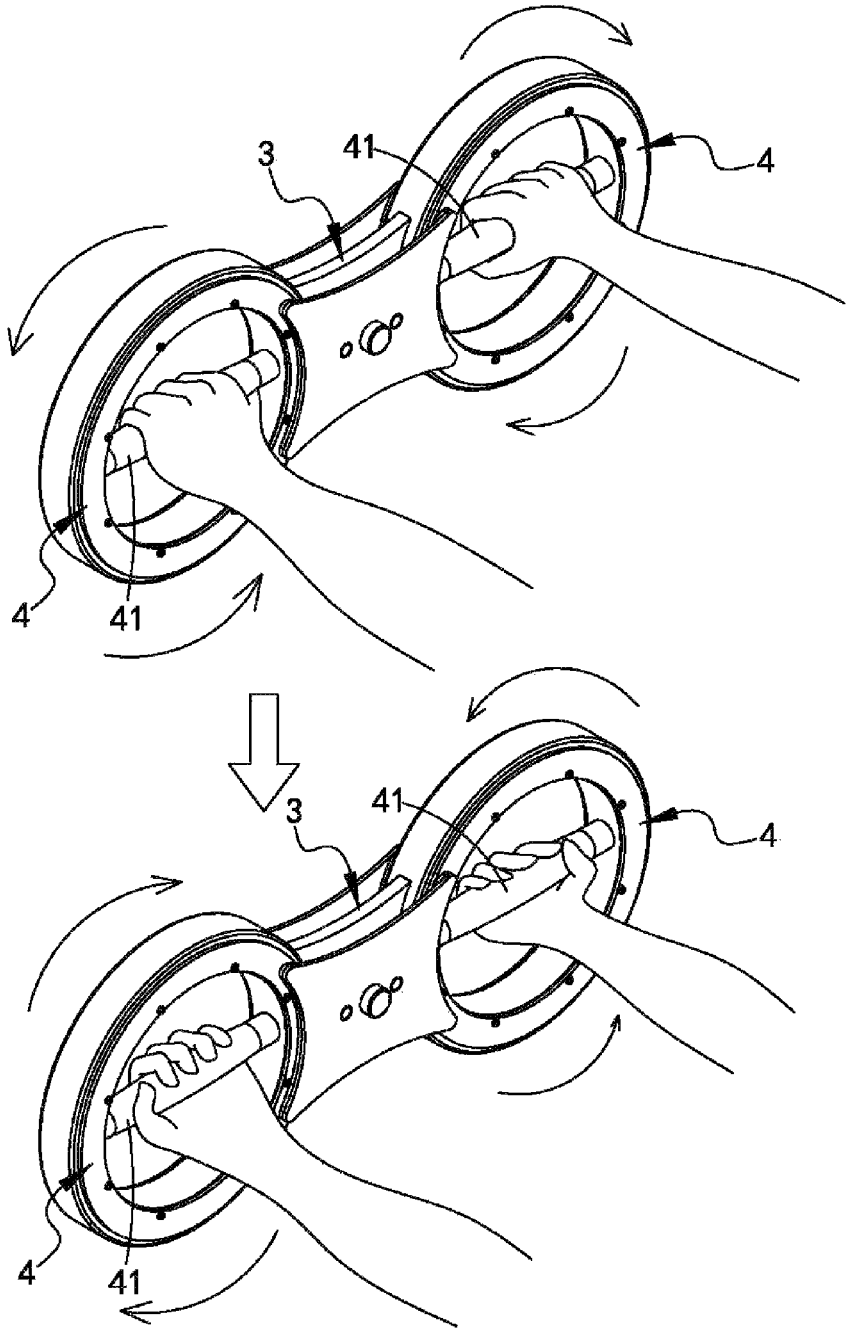
FIG. 6 shows the first operation status of the exerciser of the present invention.

As shown in FIG. 6, when using the exerciser, the user holds the two hands 41 of the two rotary members 4 by two hands and the two hands rotate the two rotary members 4 simultaneously in the same direction or different directions, while the body 3 is remained stationary.

Figure 7:
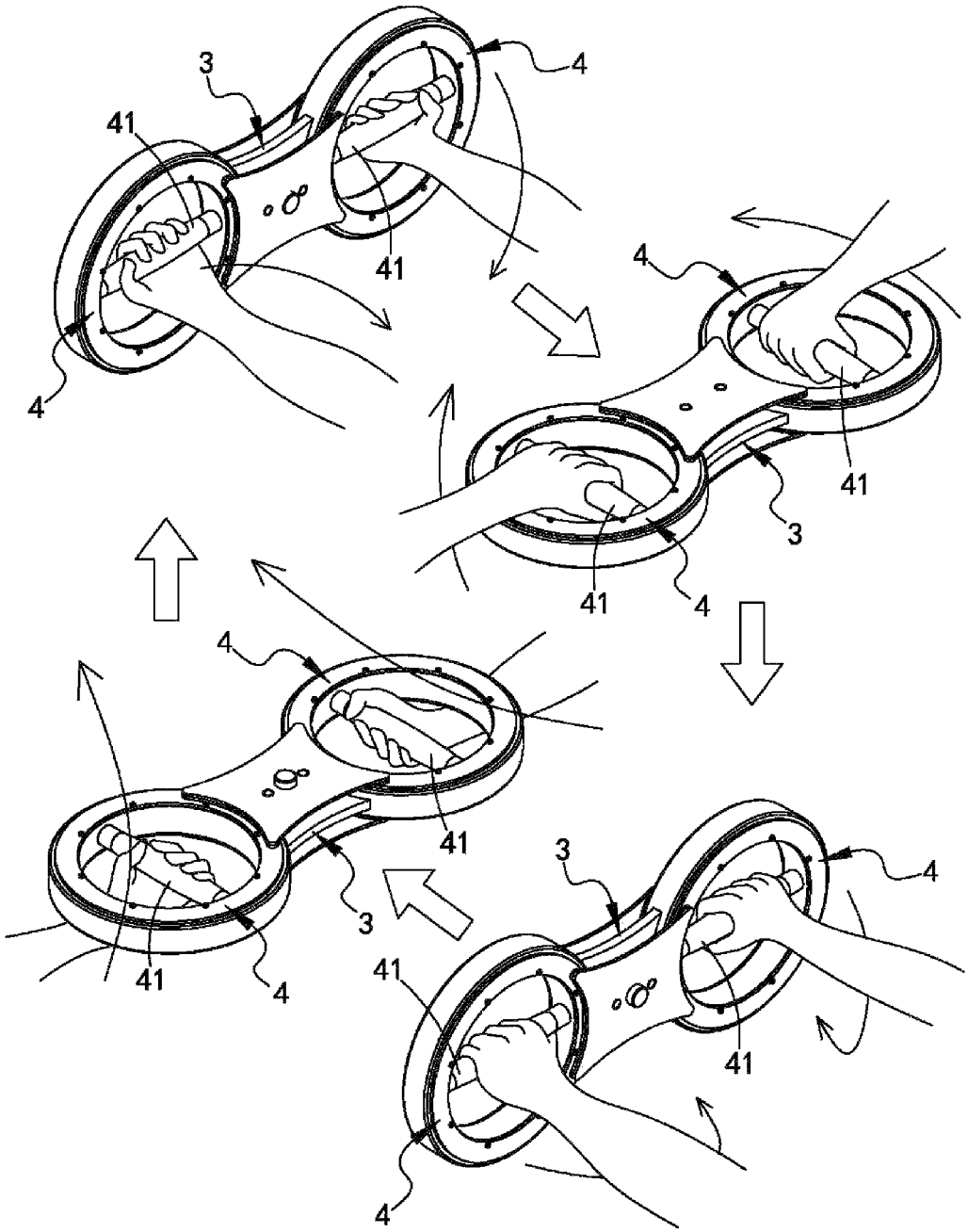
FIG. 7 shows the second operation status of the exerciser of the present invention.

As shown in FIG. 7, the second operation way is that the two arms extend straight and the hands hold the two handles 41 of the rotary members 4 normally, the body 3 is then flip between the two hands from top and the two arms extend straight again to allow the two hands holding the handles 41 in reverse directions. By repeating the actions, the arms and joints are exercised.

Figure 8:
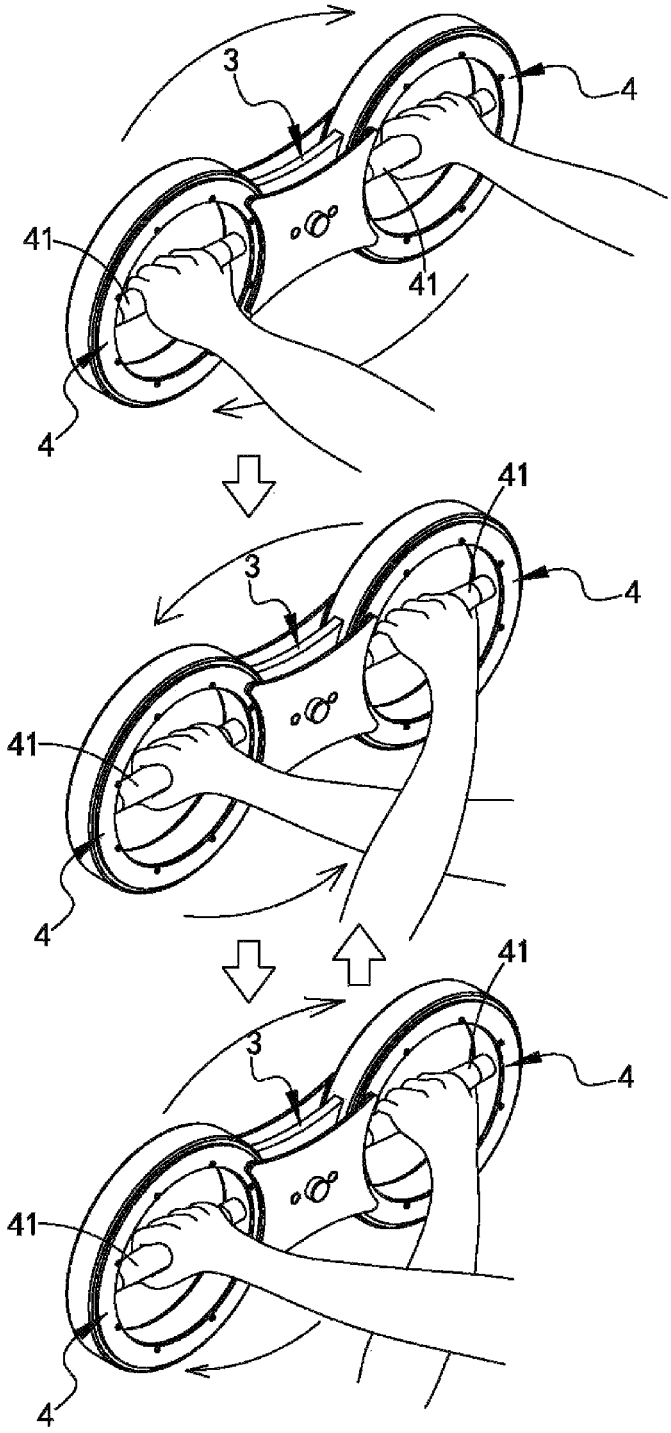
FIG. 8 shows the third operation status of the exerciser of the present invention.

As shown in FIG. 8, the third operation way is that the two arms extend straight and the hands hold the two handles 41 of the rotary members 4 normally, the connection plate 3 is rotated repeatedly in two different directions to let the two arms to be cross over each other repeatedly.

FIGS. 6 to 8 allow the user's hands to perform like Tai-chi actions.

Figure 9:
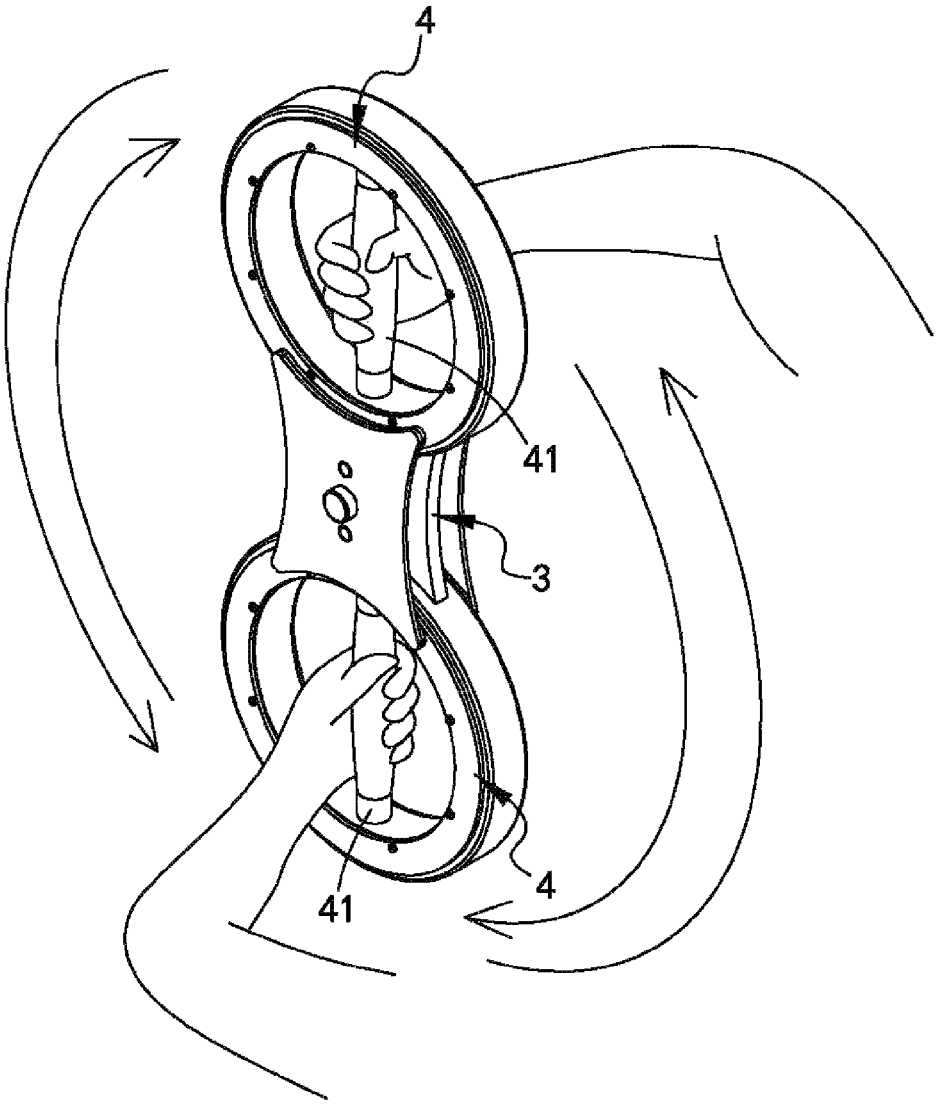
FIG. 9 shows the fourth operation status of the exerciser of the present invention.

As shown in FIG. 9, the fourth operation way is that the two arms extend straight and the hands hold the two handles 41 of the rotary members 4 from two lateral sides, and the body 3 and the handles 41 are located upright. The body 3 is operated to be rotated forward or backward to simulate boxing actions.

Figure 10:
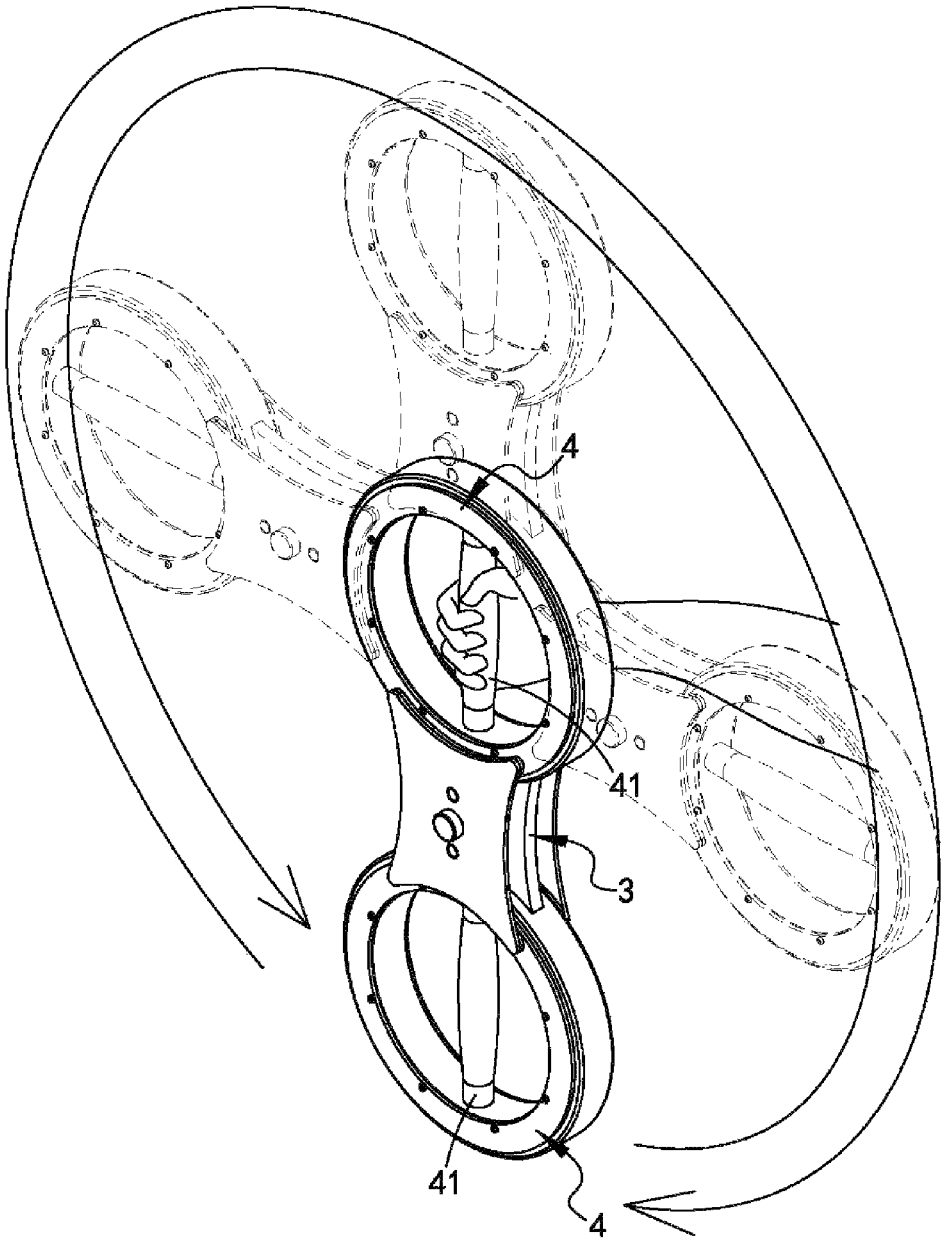
FIG. 10 shows the fifth operation status of the exerciser of the present invention.

As shown in FIG. 10, the fifth operation way is that one holds one of the handles 41 of the rotary members 4, the body 3 is then rotated to let the other rotary member 4 to rotate the rotary member 4 that is held by the hand. By initial force, the exerciser is kept to be operated.

By the operation ways described above, the muscles and joints are exercised. Especially, the knob 64 is tightened or loosened to adjust the distance between the front and rear plates 61, 60 so that the four resistance strips 62 apply different forces to the covers 42 of the rotary members 4 to generate different resistance when using the exerciser. Therefore, different requirements from different users can be met.

While we have shown and described the embodiment in accordance with the present invention, it should be clear to those skilled in the art that further embodiments may be made without departing from the scope of the present invention.

What is claimed is:

1. A resistance adjustable rotational exerciser, comprising:

a body having two outer rings and a connection plate which is connected between the two outer rings, the connection plate having a front side and a rear side which is located opposite to the front side, a through hole defined centrally through the connection plate and multiple guide rods extending from the front side and the rear side of the connection plate;

two rotary members respectively and rotatably located within the two outer rings and each rotary member having a handle, each of the rotary members having an inner ring and two covers, the inner ring being co-rotatably located in the outer ring corresponding thereto and the two respective covers mounted to front and rear sides of the inner ring, an outer periphery of each of the covers reaching to front and rear sides of the outer ring corresponding thereto, the handle connected to an inner periphery of the inner ring, two pairs of L-shaped collars respectively located between the two rotary members and the two outer rings, each collar comprising a first annular plate and a second annular plate which is perpendicular to the first annular plate, the first annular plate located between the outer ring and the inner ring, the second annular plate located between the outer ring and the cover, and an adjustment device having a rear plate, a front plate, multiple resistance strips, multiple springs and a knob, the rear plate is connected to the rear side of the connection plate and two ends of the rear plate extending to a rear side of the two rotary members, the rear plate having a connection rod and multiple rear guiding holes, the connection rod extending through the through hole and having a threaded section, the guide rods on the rear side of the connection plate extending through the rear guiding holes, the front plate connected to the front side of the connection plate and two ends of the front plate extending to a front side of the two rotary members, the threaded section of the connection rod extending through a hole defined through the front plate, the guide rods on the front side of the connection plate extending through front guiding holes defined through the front plate, the resistance strips respectively connected to the front and rear plates and being in contact with the rotary members to generate resistance, the springs respectively mounted to the guide rods and bias the front and rear plates away from the rotary members, the knob connected to the front side of the front plate and having a threaded hole with which the threaded section of the connection rod is connected.

2. The exerciser as claimed in claim 1, wherein the outer rings each have two grooves respectively defined in the front side and the rear side thereof, the two respective second annular plates of the collars are inserted into the grooves.

3. The exerciser as claimed in claim 2, wherein two ends of each of the handles are fixed to the inner rings by two threaded members.

4. The exerciser as claimed in claim 2, wherein the two covers are fixed to the front and rear sides of the inner rings by multiple bolts.

5. The exerciser as claimed in claim 2, wherein the collars comprise polytetrafluoroethylene.

* * * * *